US011744359B2

(12) United States Patent
Hu et al.

(10) Patent No.: US 11,744,359 B2
(45) Date of Patent: Sep. 5, 2023

(54) PNEUMATIC LIFTING TABLE FRAME AND LIFTING TABLE

(71) Applicant: NINGBO HEALTHKEY MOTION TECHNOLOGY CO., LTD, Zhejiang (CN)

(72) Inventors: Renchang Hu, Zhejiang (CN); Qingyu Meng, Zhejiang (CN); Donghang Zhang, Zhejiang (CN); Yujie Cen, Zhejiang (CN)

(73) Assignee: NINGBO HEALTHKEY MOTION TECHNOLOGY CO., LTD, Zhejiang (CN)

( * ) Notice: Subject to any disclaimer, the term of this patent is extended or adjusted under 35 U.S.C. 154(b) by 0 days.

(21) Appl. No.: 17/761,598

(22) PCT Filed: Dec. 1, 2020

(86) PCT No.: PCT/CN2020/133179
§ 371 (c)(1),
(2) Date: Mar. 18, 2022

(87) PCT Pub. No.: WO2021/139450
PCT Pub. Date: Jul. 15, 2021

(65) Prior Publication Data

US 2022/0378193 A1 Dec. 1, 2022

(30) Foreign Application Priority Data

Jan. 9, 2020 (CN) ..... 202010021692.3

(51) Int. Cl.
*A47B 9/10* (2006.01)
*A47B 9/12* (2006.01)

(52) U.S. Cl.
CPC ..... *A47B 9/10* (2013.01); *A47B 9/12* (2013.01); *A47B 2200/0056* (2013.01)

(58) Field of Classification Search
CPC ..... A47B 9/10; A47B 9/12; A47B 2200/0056
See application file for complete search history.

(56) References Cited

U.S. PATENT DOCUMENTS 10,213,015 B1 * 2/2019 Anderson ..... A47B 9/10
11,497,304 B1 * 11/2022 Pan ..... A47B 9/20
(Continued)

FOREIGN PATENT DOCUMENTS

CN 103315519 9/2013
CN 108720266 11/2018
(Continued)

OTHER PUBLICATIONS

English translation of CN 1033155191A from espacenet (Year: 2023).*
(Continued)

*Primary Examiner* — Daniel J Rohrhoff
(74) *Attorney, Agent, or Firm* — JCIPRNET

(57) ABSTRACT

A pneumatic lifting table frame includes a transverse beam, at least one column, a pressure sensor that detects a load of the lifting table frame, a controller configured to receive a signal from the pressure sensor, and an adjustable gas spring assembly configured to drive the column to be lifted or lowered. The adjustable gas spring assembly includes an adjustable gas spring body, a gas reservoir, a piston rod assembly, and a drive unit. The adjustable gas spring body is connected to the gas reservoir via a gas pipe. The controller is configured to control the drive unit, the adjustable gas spring body (401) is disposed in one of the column, and the drive unit drives the piston rod assembly to carry out a piston motion in the gas reservoir.

8 Claims, 3 Drawing Sheets

(56) References Cited

U.S. PATENT DOCUMENTS

| | | | | |
|---|---|---|---|---|
| 2017/0042322 | A1* | 2/2017 | Labrosse | A47B 21/02 |
| 2020/0077788 | A1* | 3/2020 | Albers | A47B 9/12 |
| 2020/0163451 | A1* | 5/2020 | Tao | A47B 9/10 |
| 2020/0305594 | A1* | 10/2020 | Lin | A47B 9/14 |
| 2021/0000250 | A1* | 1/2021 | Høyer | A47B 9/20 |
| 2022/0295982 | A1* | 9/2022 | Zheng | A47B 9/10 |
| 2022/0304462 | A1* | 9/2022 | Koch | A47B 9/04 |

FOREIGN PATENT DOCUMENTS

| | | |
|---|---|---|
| CN | 109757856 | 5/2019 |
| CN | 110056593 | 7/2019 |
| CN | 111109841 | 5/2020 |
| DE | 202019105474 | 12/2019 |
| JP | 2019170752 | 10/2019 |

OTHER PUBLICATIONS

"Search Report of Europe Counterpart Application", dated Sep. 30, 2022, p. 1-p. 8.

"International Search Report (Form PCT/ISA/210) of PCT/CN2020/133179," dated Feb. 26, 2021, with English translation thereof, pp. 1-4.

* cited by examiner

PNEUMATIC LIFTING TABLE FRAME AND LIFTING TABLE

CROSS-REFERENCE TO RELATED APPLICATION

This application is a 371 of international application of PCT application serial no. PCT/CN2020/133179 filed on Dec. 1, 2020 which claims the priority benefit of China application no. 202010021692.3, filed on Jan. 9, 2020. The entirety of each of the above mentioned patent applications is hereby incorporated by reference herein and made a part of this specification.

TECHNICAL FIELD

Embodiments of the present disclosure relate to lifting mechanisms, and more particularly relate to a pneumatic lifting table frame and a lifting table.

DESCRIPTION OF RELATED ART

Tables are indispensable household and office supplies. Conventional tables have a fixed height, which cannot be adjusted to satisfy individual conditions and actual needs. Such tables have a low comfort, and with long-term use, are prone to cause spinal diseases. A height adjustable lifting table enables adjustment based on individual body shapes and sizes and thus may enhance comfort and relieve pain. Currently available lifting tables are generally manually operated or electrically actuated. A manually operated lifting table is strenuous and prone to deforming and damaging the handle and transmission assembly in cases of overly heavy load. An electric lifting table needs to be placed in an area with a power outlet; besides, operating of the electric lifting table consumes electricity, causing energy waste; meanwhile, the motor and actuation system generate an overly large noise, are fault-prone, and also cost highly. Pneumatic lifting tables are now increasingly embraced by consumers due to their low cost and low noise. A pneumatic lifting table is actuated by a gas spring. However, due to its inherent structure and properties, the gas spring renders an unsteady lifting/lowering speed when a user adjusts the table; further, if the top of the table has an overly heavy load, the lifting process is not smooth; while if the top of the table has a too light load, the lifting speed becomes too fast, likely causing injuries/damages to people or objects nearby.

SUMMARY

To overcome the above and other drawbacks in conventional technologies, embodiments of the present disclosure provide a pneumatic lifting table frame that operates safely with a low damage possibility and a stable lifting/lowering speed.

Embodiments of the Present Disclosure Provide

A pneumatic lifting table frame includes a transverse beam, at least one column, a pressure sensor configured to detect a load of the lifting table frame, a controller configured to receive a signal from the pressure sensor, and an adjustable gas spring assembly configured to drive the column to be lifted or lowered. The adjustable gas spring assembly comprises an adjustable gas spring body, a gas reservoir, a piston rod assembly, and a drive unit. The adjustable gas spring body is connected to the gas reservoir via a gas pipe. The controller is configured to control the drive unit, the adjustable gas spring body is disposed in one of the column, and the drive unit drives the piston rod assembly to carry out a piston motion in the gas reservoir.

The Present Disclosure Offers the Following Beneficial Effects

1. When the lifting table frame operates, the pressure sensor detects a load of the lifting table frame and transmits a signal to the controller. The controller controls rotation direction and magnitude of the drive unit based on the signal received to thereby control traveling direction and distance of the piston rod assembly in the gas reservoir. Since the adjustable gas spring body and the gas reservoir are connected via a gas pipe, gas is allowed to communicate between their insides. When the lifting table frame has a heavy load, the piston rod assembly is pushed inwardly, such that the gas in the gas reservoir is partially pressed into the adjustable gas spring body, which increases the pressure in the adjustable gas spring body and thus increases the thrust force against the column, thereby achieving a balance between the thrust force and the load force of the lifting table frame, which ensures a uniform lifting/lowering speed of the lifting table frame. When the lifting table frame has a relatively light load, the piston rod assembly is pulled outward, with an operating process and a working principle reverse to the operating process and working principle described above, which are thus not detailed here. By controlling increase or decrease of the gas in the adjustable gas spring body, the lifting table frame may always carry out lifting/lowering at a steady speed irrespective of whether the lifting table frame has a heavy or light load, which avoids occurrence of lifting/lowering difficulty or an overly high lifting/lowering speed, thereby enhancing operational safety and facilitating lifting/lowering. In addition, the lifting table frame according to the present disclosure offers a better comfort, a longer service life, a higher stability, a stronger practicality, and a lower damage possibility.

2. A sealing connection manner employed by the adjustable gas spring assembly does not cause loss of gas quantity in the adjustable gas spring body and the gas reservoir. Therefore, the total gas quantity maintains constant, which only fluctuates reciprocally in the insides of the adjustable gas spring body and the gas reservoir via the gas pipe. In this way, pressure variation inside the adjustable gas spring body may be ensured without supplementing gas into the adjustable gas spring body and the gas reservoir. Therefore, the gas may be cyclically used, which saves time, effort, and cost. The adjustable gas spring assembly has a simple structure and is conveniently operated.

In an embodiment, the column comprises a first column and a second column disposed at two ends of the transverse beam, respectively. The adjustable gas spring body is disposed in the first column. A synchronous lifting transmission mechanism is provided between the first column and the second column.

In an embodiment, the first column comprises a first upper column and a first lower column sleeved on the first upper column; the second column comprises a second upper column and a second lower column; a first fixed post is provided in the first column, and a second fixed post is provided in the second column; a first cable guide wheel is provided at a lower side of an inner wall of the first upper column, and a second cable guide wheel is provided at a lower side of an inner wall of the second upper column; the synchronous lifting transmission mechanism comprises a first transmission belt and a second transmission belt which are spaced apart from each other at an interval. One end of the first transmission belt is fixed to a bottom end of the first lower column, another end of the first transmission belt extends out through a top end of the first column and then into the second column, and is fixed on the second fixed post after passing over the second cable guide wheel. One end of the second transmission belt is fixed to a bottom end of the second lower column, and another end of the second transmission belt extends out through a top end of the second column and then into the first column, and is fixed on the first fixed post after passing over the first cable guide wheel.

In an embodiment, the first fixed post is disposed in the first column, a lengthwise direction of the first fixed post is consistent with a lifting/lowering direction of the first column; the second fixed post is disposed in the second column, and a lengthwise direction of the second fixed post is consistent with a lifting lowering direction of the second column.

In an embodiment, a first mounting box for securing the first column to the transverse beam and a second mounting box for securing the second column to the transverse beam are provided at two ends of the transverse beam, respectively. A first fixed rack is provided in the first mounting box, a first fixed pulley and a second fixed pulley are spaced apart from each other on the first fixed rack in a fore and aft direction; a second fixed rack is provided in the second mounting box, and a third fixed pulley and a fourth fixed pulley are spaced apart from each other on the second fixed rack in a fore and aft direction. The first transmission belt, after extending out through the first column, passes over the first fixed pulley and the third fixed pulley and is fixed on the second fixed post; and the second transmission belt, after extending out through the second column, passes over the second fixed pulley and the fourth fixed pulley and is fixed on the first fixed post.

In an embodiment, a self-locking gas spring for driving the second column to lift/lower is provided in the second column. The self-locking gas spring comprises a first self-locking pin and a first cable pulling lever that controls the first self-locking pin, a first cable is provided outside the first cable pulling lever. An end of the first cable is connected to the first cable pulling lever, and the other end of the first cable is connected to a first switch.

In an embodiment, the column is a single column disposed in a middle of the transverse beam. The adjustable gas spring body is a self-locking adjustable gas spring, the self-locking adjustable gas spring includes a second self-locking pin and a second cable pulling lever that controls the second self-locking pin, a second cable is provided outside the second cable pulling lever. An end of the second cable is connected to the second cable pulling lever, and the other end of the second cable is connected to a second switch.

In an embodiment, a mounting casing is securely provided on the transverse beam, wherein the controller, the drive unit, the piston rod assembly, and the gas reservoir are disposed in the mounting casing.

In an embodiment, the drive unit is a drive motor. The piston rod assembly comprises a screw rod and a piston nut that is sleeved over the screw rod and moves axially along the screw rod, an output end of the drive motor is connected to the screw rod, and the piston nut is disposed in the gas reservoir and interference-fitted with an inner wall of the gas reservoir.

Another technical solution of the present disclosure provides:

A pneumatic lifting table includes a table top. The pneumatic lifting table frame according to any of the technical solutions above is disposed beneath the table top.

These characteristics and advantages of the disclosure will be disclosed in detail through the embodiments below with reference to the accompanying drawings.

BRIEF DESCRIPTION OF THE DRAWINGS

Hereinafter, the disclosure will be described in further detail with reference to the accompanying drawings.

DESCRIPTION OF THE EMBODIMENTS

Figure 1:
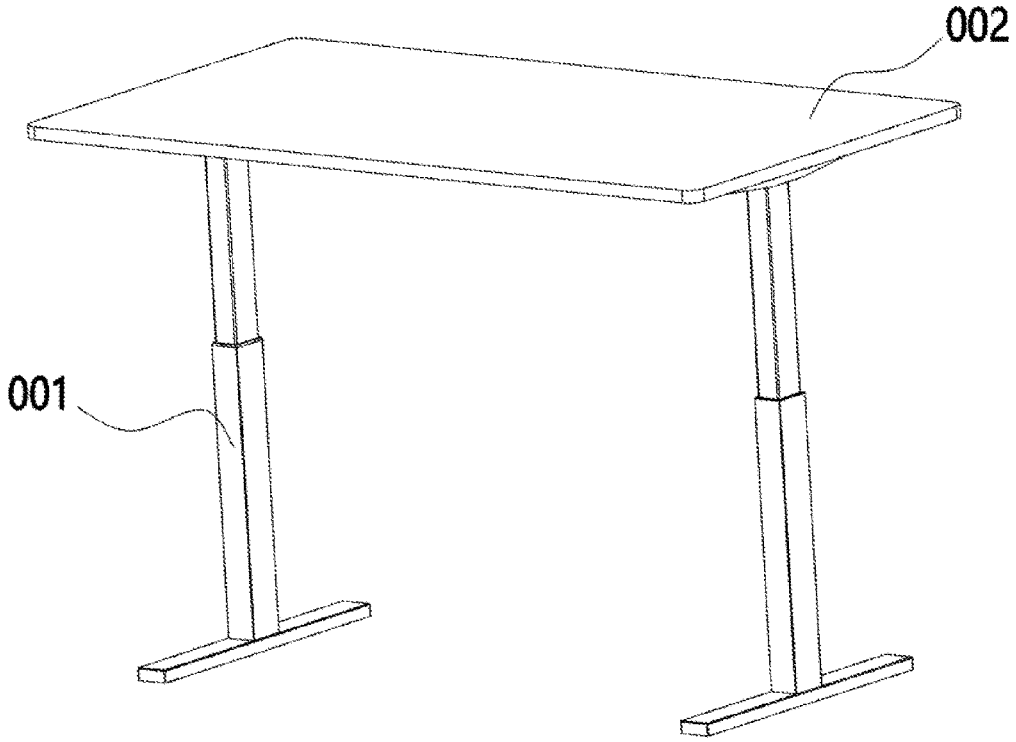
FIG. 1 is a stereoscopic structural schematic view of a lifting table according to the present disclosure.

Hereinafter, the technical solutions of the present disclosure will be explained and illustrated through embodiments with reference to the accompanying drawings. However, the embodiments are only some embodiments of the present disclosure, not all of them. Other embodiments obtained by those skilled in the art without exercise of inventive work based on the examples in the embodiments all fall within the protection scope of the present disclosure.

In the description of the present disclosure, it needs to be understood that the orientational or positional relationships indicated by the terms "center," "longitudinal," "transverse," "length," "width," "thickness", "upper," "lower," "front," "rear," "left," "right," "vertical," "horizontal," "top," "bottom," "inner," "clockwise," "counterclockwise," etc. are orientational and positional relationships based on the drawings, which are intended only for facilitating description of the present disclosure and simplifying relevant illustrations, not for indicating or implying that the devices or elements compulsorily possess those specific orientations and are compulsorily configured and operated with those specific orientations; therefore, such terms should not be construed as limitations to the present disclosure.

Besides, the terms "first" and "second" are only used for descriptive purposes, which shall not be construed as indicating or implying relative importance or implicitly indicating the amount of a referred to technical feature. Therefore, the features limited by "first" and "second" may explicitly or implicitly include one or more of such features. In the description of the present disclosure, unless otherwise indicated, "plurality" indicates two or above.

In the present disclosure, unless otherwise explicitly provided and limited, the terms such as "mount," "connect," "couple," and "fix" should be understood broadly, which, for example, may refer to a fixed connection, a detachable connection, or an integral connection; which may be a mechanical connection or an electrical connection; which may be a direct connection or an indirect connection via an intermediate medium; which may also be a communication between the insides of two elements. To a person of normal skill in the art, specific meanings of the above terms in the present disclosure may be construed based on specific situations.

In the present disclosure, unless otherwise explicitly provided and limited, an expression that a first feature is "above" or "below" a second feature may refer to a direct contact between the first feature and the second feature or may refer to a scenario where although the first feature and the second feature do not contact directly, they contact via a further feature therebetween. Moreover, the expression that the first feature is "above" or "over" or "on" the second feature refers to a situation where the first feature is exactly or generally over the second feature or only refers to a situation that the horizontal height of the first feature is higher than the second feature. The expression that the first feature is "under" or "below" or "beneath" the second feature refers to a situation where the first feature is exactly or generally below the second feature or only refers to a situation that the horizontal height of the first feature is lower than the second feature.

First Embodiment

Figure 3:
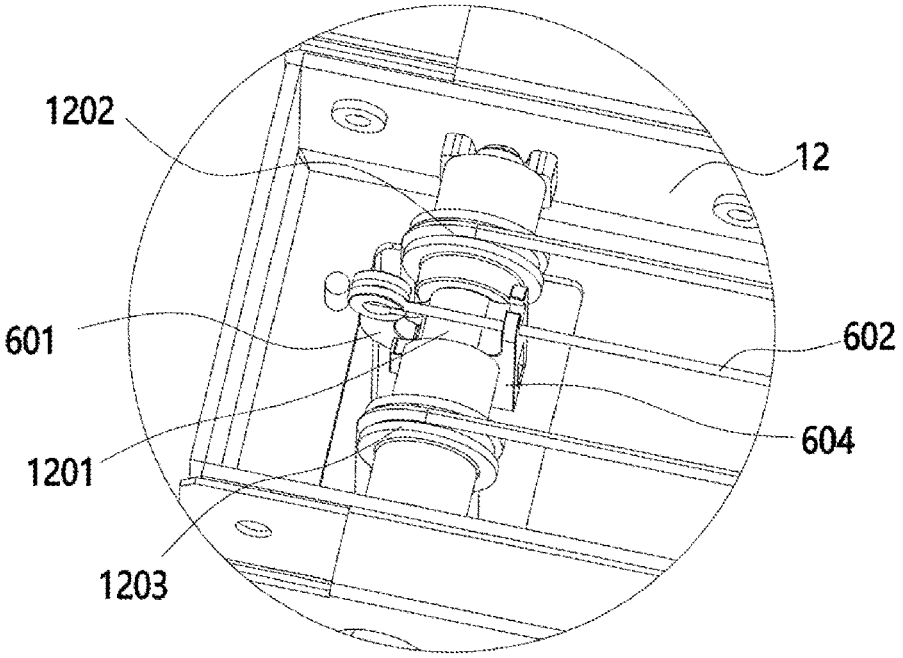
FIG. 3 is a locally enlarged view of part A in FIG. 2.
Figure 4:
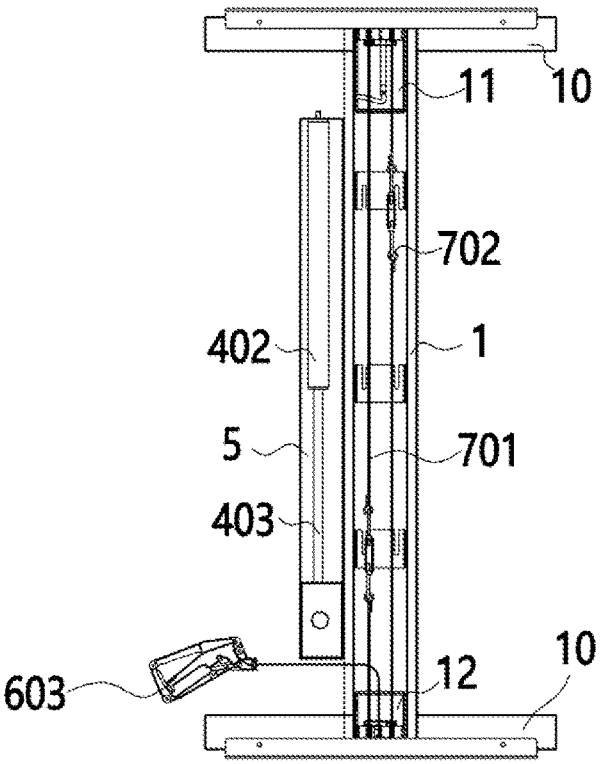
FIG. 4 is a top view of the lifting table frame according to the present disclosure.
Figure 5:
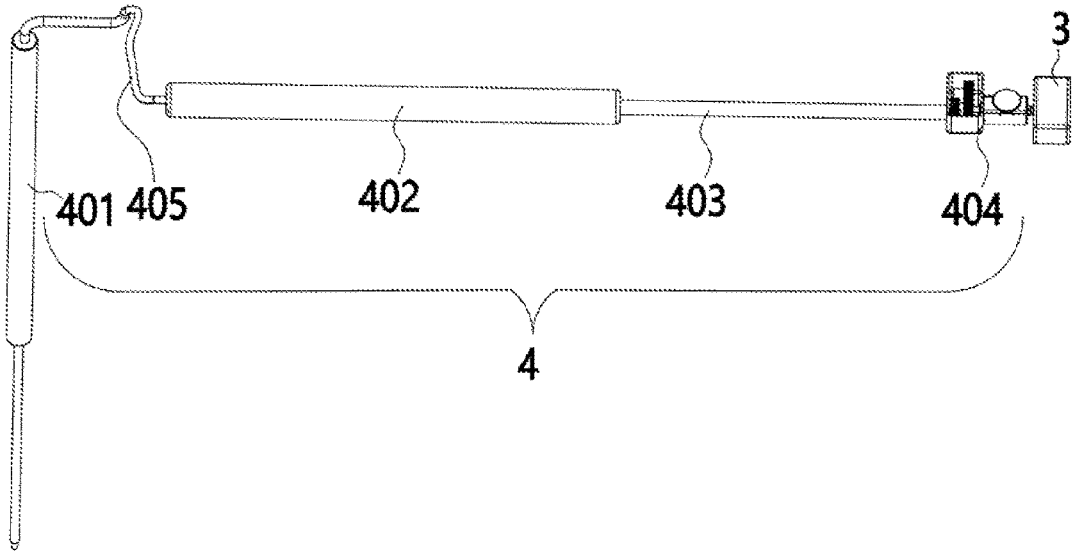
FIG. 5 is a structural schematic view of an adjustable gas spring assembly according to the present disclosure.

FIG. 2 to FIG. 6 illustrate a pneumatic lifting table frame 001. The pneumatic lifting table frame 001 comprises a transverse beam 1 and columns 2. The lifting table frame 001 further comprises a pressure sensor configured to detect a load of the lifting table frame 001, a controller 3 configured to receive a signal from the pressure sensor, and an adjustable gas spring assembly 4 configured to drive the columns 2 to be lifted or lowered. As illustrated in FIG. 5, the adjustable gas spring assembly 4 comprises an adjustable gas spring body 401, a gas reservoir 402, a piston rod assembly 403, and a drive unit 404. The adjustable gas spring body 401 is connected to the gas reservoir 402 via a gas pipe 405. The controller 3 is configured to control the drive unit 404, the adjustable gas spring body 401 is disposed in one of the columns 2, and the drive unit 404 drives the piston rod assembly 403 to carry out a piston motion in the gas reservoir 402.

When the lifting table o frame 001 operates, the pressure sensor detects a load of the lifting table frame 001 and transmits a signal to the controller 3. The controller 3 controls rotation direction and magnitude of the drive unit 404 based on the signal received to thereby control traveling direction and distance of the piston rod assembly 403 in the gas reservoir 402. Since the adjustable gas spring body 401 and the gas reservoir 402 are connected via a gas pipe 405, gap is allowed to communicate between their insides. When the lifting table frame 001 has a relatively heavy load, the piston rod assembly 403 is pushed inwardly, such that the gas in the gas reservoir 402 is partially pressed into the adjustable gas spring body 401, which increases the pressure in the adjustable gas spring body 401 and thus increases the thrust force against the column 2 where it is disposed, thereby achieving a balance between the thrust force and the load force of the lifting table frame 001, which ensures a uniform lifting/lowering speed of the lifting table frame 001. When the lifting table frame 001 has a relatively light load, the piston rod assembly 403 is pulled outward with an operating process and a working principle reverse to the operating process and working principle described above, which are thus not detailed here. A reference threshold may be set in the controller 3, such that when the load of the lifting table frame 001 is greater than the reference threshold, the controller 3 controls the drive unit 404 to rotate forwardly to increase the gas spring force. While when the load of the lifting table frame 001 is lower than the reference threshold, the controller 3 controls the drive unit 404 to rotate reversely to decrease the gas spring force. Meanwhile, correspondences between load values of the lifting table frame 001 and rotation magnitudes of the drive unit 4 are also provided in the controller 3 to satisfy operating balance for users. By controlling increase or decrease of the gas in the adjustable gas spring body 401, the lifting table frame 001 may always carry out lifting/lowering at a steady speed irrespective of whether the lifting table frame 001 has a heavy or light load, which avoids occurrence of lifting/lowering difficulty or overly high lifting/lowering speed, thereby enhancing operational safety and facilitating lifting/lowering. In addition, the lifting table frame 001 offers a better comfort, a longer service life, a higher stability, a stronger practicality, and a lower damage possibility. A sealing connection manner as employed by the adjustable gas spring assembly 4 does not cause loss of gas quantity in the adjustable gas spring body 401 and gas reservoir 402. Therefore, the total gas quantity maintains constant, which only fluctuates reciprocally in the insides of the adjustable gas spring body 401 and the gas reservoir 402 via a gas pipe 405. In this way, pressure variation inside the adjustable gas spring body 401 may be ensured without supplementing gas into the adjustable gas spring body 401 and the gas reservoir 402. Therefore, the gas may be cyclically used, which saves time, effort, and cost. The adjustable gas spring assembly 401 has a simple structure and is conveniently operated. The pressure sensor may be disposed at any position where the lifting table frame 001 interfaces with the table top 002.

Figure 2:
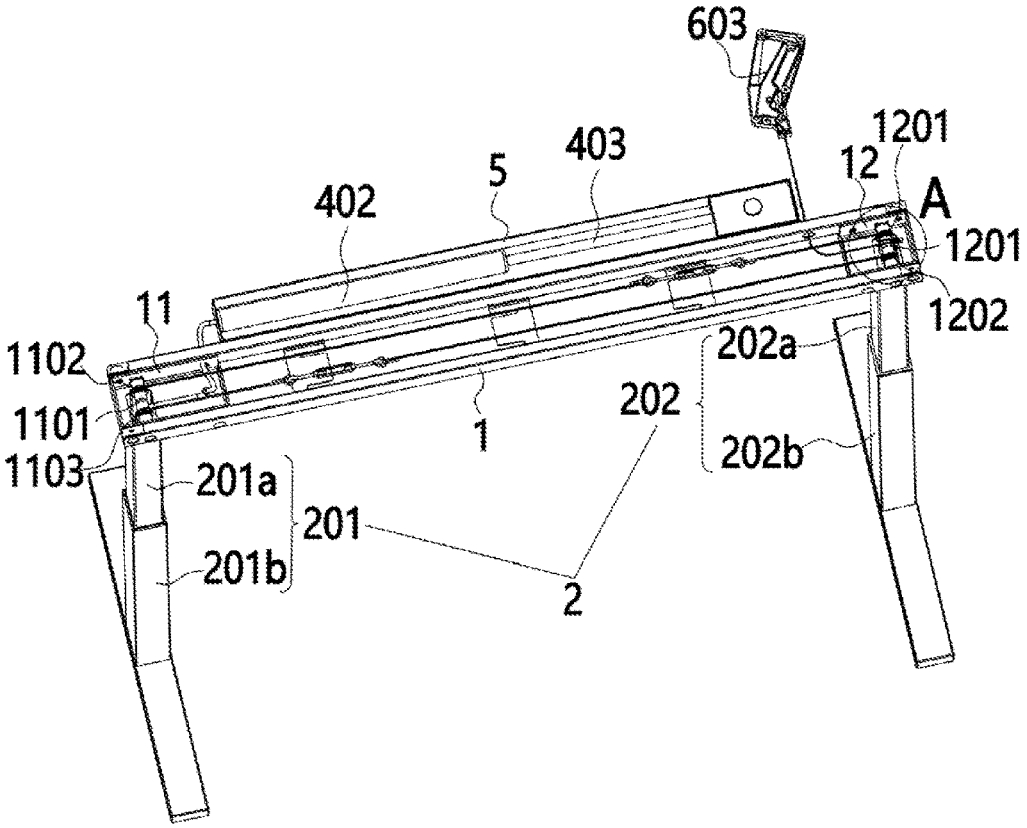
FIG. 2 is a stereoscopic structural schematic view of a lifting table frame according to the present disclosure.

In this embodiment, the drive unit 404 is preferably a drive motor. To facilitate installation of components, as illustrated in FIG. 2 and FIG. 5, a mounting casing 5 is securely provided on the transverse beam 1. The controller 3, the drive unit, the piston rod assembly 403, and the gas reservoir 402 are disposed in the mounting casing 5. The piston rod assembly 403 comprises a screw rod and a piston nut that is sleeved over the screw rod and moves axially along the screw rod, an output end of the drive motor is connected to the screw rod, and the piston nut is disposed in the gas reservoir 402 and interference-fitted with an inner wall of the gas reservoir 402. Upon operation, the drive motor is activated to drive the screw rod to rotate. The piston nut on the screw rod moves in a fore and aft direction to push out gas from the gas reservoir 402 or draw gas into the gas reservoir 402, thereby carrying out adjustment on gas pressure in the adjustable gas spring body.

It is noted that in another embodiment, the piston rod assembly 403 is not limited to a combination of crew rod and piston nut, which may also be for example a typical hydraulically actuated piston rod. All of such alternatives fall into the protection scope of the present disclosure as long as they are capable of adjusting gas pressure between the gas reservoir 402 and the adjustable gas spring body 401.

Figure 6:
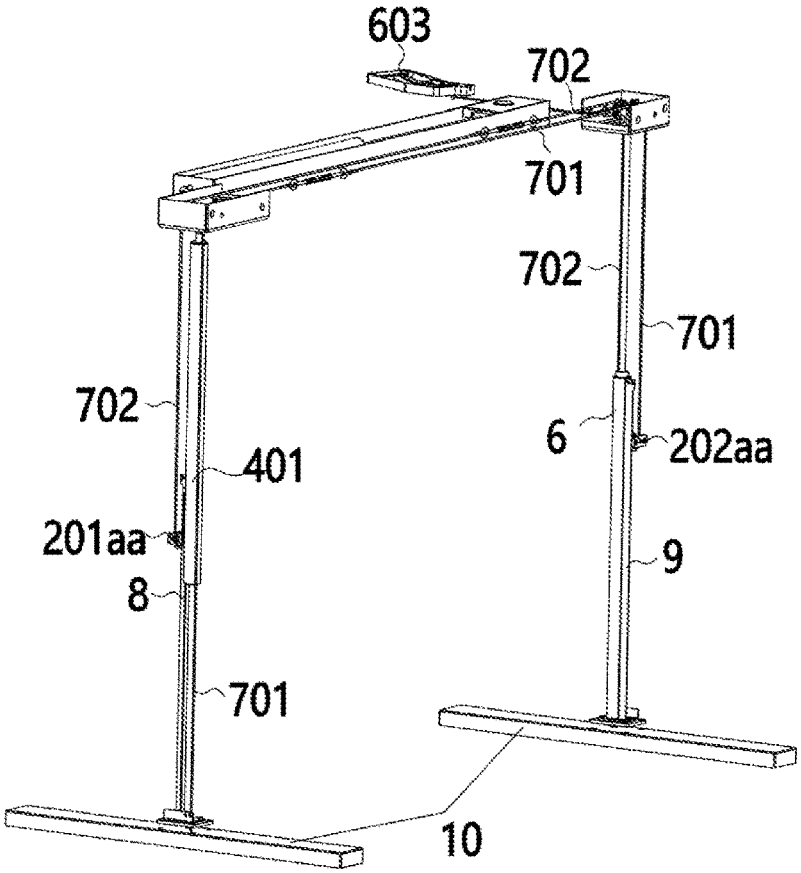
FIG. 6 is a structural schematic view of a synchronous lifting transmission mechanism of the lifting table according to the present disclosure.

In this embodiment, the lifting table frame 001 is provided with two or more columns 2, preferably two columns 2. As illustrated in FIG. 2, FIG. 3, and FIG. 6, the columns 2 comprise a first column 201 and a second column 202, which are disposed at two ends of the transverse beam 1, respectively. The adjustable gas spring body 401 is disposed in the first column 201. A self-locking gas spring 6 is provided in the second column 202. The self-locking gas spring 6 includes a first self-locking pin and a first cable pulling lever 601 that controls the first self-locking pin, a first cable 602 is provided outside the first cable pulling lever 601. An end of the first cable 602 is connected to the first cable pulling lever 601, and the other end of the first cable 602 is connected to a first switch 603. To facilitate positioning and pulling of the first cable 602 and to prevent tangling of the first cable 602, a positioning block 604 is provided opposite the first cable pulling lever 601, and a positioning hole is provided in the positioning block 604, the first cable 602 passing through the positioning hole.

As illustrated in FIG. 2, the first column 201 comprises a first upper column 201*a* and a first lower column 201*b*. The second column 202 comprises a second upper column 202*a* and a second lower column 202*b*. As illustrated in FIG. 6, a first fixed post 8 is provided in the first column 201, and a second fixed post 9 is provided in the second column 202. A length direction of the first fixed post 8 is consistent with a lifting/lowering direction of the first column 201, and a length direction of the second fixed post 9 is consistent with a lifting/lowering direction of the second column 202. A first cable guide wheel 201*aa* is provided at a lower side of an inner wall of the first upper column 201*a*, and a second cable guide wheel 202*aa* is provided at a lower side of an inner wall of the second upper column 202*a*. To ensure balance and stability of the lifting table frame 001, a synchronous lifting transmission mechanism 7 is provided between the first column 201 and the second column 202. In this embodiment, the synchronous lifting transmission mechanism 7 comprises a first transmission belt 701 and a second transmission belt 702, which are spaced apart from each other at an interval. One end of the first transmission belt 701 is fixed to a bottom end of the first lower column 201*b*, and another end of the first transmission belt 701 extends out through a top end of the first column 201 and then into the second column 202, and is fixed on the second fixed post 9 after passing over the second cable guide wheel 202*aa*. One end of the second transmission belt 702 is fixed to a bottom end of the second lower column 202*b*, and another end of the second transmission belt 702 extends out through a top end of the second column 202 and then into the first column 201, and is fixed on the first fixed post 8 after passing over the first cable guide wheel 201*aa*.

With the synchronous lifting transmission mechanism 7 of the lifting table frame 001, to carry out lifting, the first switch 603 is turned on to actuate the first cable 602 to pull the first cable pulling lever 601 to rotate, which presses against the first self-locking pin of the self-locking gas spring 6. The self-locking gas spring 6 is in a freely adjustable status, such that a push rod of the self-locking gas spring 6 pushes the second upper column 202*a* to lift upward, and the second cable guide wheel 202*aa* lifts upward with the second upper column 202*a*. The first transmission belt 701 is in a slacked and adjustable status, and at the same time, lifting of the second upper column 202*a* pulls the second transmission belt 702, such that the second transmission belt 702 brings the first cable guide wheel 201*aa* to move upward while sliding beneath the first cable guide wheel 201*aa*, and that the first upper column 201*a* is brought to lift. When the first upper column 201*a* is lifting, it further pulls the second transmission belt 702 tightly. The lifting stroke and speed of the first upper column 201*a* are identical to those of the second upper column 202*a*, and the above actions are continuously repeated during the lifting process. The motion principle of a lowering process is reverse to the lifting process. The same principle also applies to the first column 201 bringing the second column 202 to lift /lower, which will not be detailed here for brevity. The dual-transmission belt structure of the synchronous lifting transmission mechanism 7 enables mutual actuation and mutual restriction between the first column 201 and the second column 202, thereby realizing a synchronous, stable lifting/lowering process, which maintains horizontal orientation of the table top 002 and prevents tilting thereof. Besides, the synchronous lifting transmission mechanism 7 has a steady, reliable performance and costs less, wherein the transmission belts may select various kinds of flexible elongated connectors such as steel wire, steel belt, and rope.

It is understood that a lower end of each column 2 may comprise a ground anchor 10. One end of the steel wire may be secured on the ground anchor 10 or on a connecting block provided between the ground anchor 10 and the column 2.

It is noted that in another embodiment, the synchronous lifting transmission mechanism 7 is not limited to the above dual-transmission belt structure, which may also be a hexagonal driving rod or any mechanism, as long as the function of synchronous transmission can be implemented, falls within the protection scope of the present disclosure.

A first mounting box 11 for securing the first column 201 to the transvers beam 1 and a second mounting box 12 for securing the second column 202 to the transverse beam 1 are provided at two ends of the transverse beam 1, respectively. As illustrated in FIG. 2 and FIG. 4, to facilitate sliding, reduce wear, and extend service life of the transmission belts, a first fixed rack 1101 is provided in the first mounting box 11, and a first fixed pulley 1102 and a second fixed pulley 1103 are spaced apart from each other in a fore and aft direction on the first fixed rack 1101. A second fixed rack 1201 is provided in the second mounting box 12, and a third fixed pulley 1202 and a fourth fixed pulley 1203 are spaced apart from each other in a fore and aft direction on the second fixed rack 1201. The first transmission belt 701, after extending out through the first column 201, passes over the first fixed pulley 1102 and the third fixed pulley 1202 and is fixed on the second fixed post 9. The second transmission belt 702, after extending out through the second column 202, passes over the second fixed pulley 1103 and the fourth fixed pulley 1203, and is fixed on the first fixed post 8. By arranging two fixed pulleys on each fixed post such that the first transmission belt 701 and the second transmission belt 702 pass over different fixed pulleys, tangling of the transmission belts is prevented and sliding is facilitated, which enhances efficiency and reduces maintenance frequency and cost.

In this embodiment, the dual-column pneumatic table offers a stationary self-locking force as high as 2500N and a dynamic load range from 0 to 800N.

It is understood that the adjustable gas spring assembly 4 described in this embodiment is not only applicable to a lifting table, but also applicable to lifting furniture or medical equipment such as a lifting bed, a lifting sofa, etc.

Second Embodiment

This embodiment differs from the first embodiment in that the pneumatic lifting table frame 001 only comprises a single column 2 disposed in the middle of the transverse beam 1. The adjustable gas spring body 401 refers to a self-locking adjustable gas spring. The self-locking adjustable gas spring includes a second self-locking pin and a second cable pulling lever that controls the second self-locking pin. A second cable is provided outside the second cable pulling lever. An end of the second cable is connected to the second cable pulling lever, and the other end of the second cable is connected to a second switch.

Third Embodiment

A pneumatic lifting table, as illustrated in FIG. 1, comprises a table top 002, wherein the pneumatic lifting table frame 001 according to the first or second embodiment is disposed beneath the table top 002.

What have been described above are only embodiments of the present disclosure; however, the protection scope of the present disclosure is not limited thereto. A person skilled in the art should understand that the disclosure includes, but is not limited to, the contents described in the drawings and the embodiments. Any modifications without departing from the functions and structural principles of the disclosure will be included within the scope of the claims.

What is claimed is:

1. A pneumatic lifting table frame, comprising a transverse beam, at least one column, a pressure sensor configured to detect a load of the lifting table frame, a controller configured to receive a signal from the pressure sensor, and an adjustable gas spring assembly configured to drive the column to be lifted or lowered;

wherein the adjustable gas spring assembly comprises an adjustable gas spring body, a gas reservoir, a piston rod assembly, and a drive unit, the adjustable gas spring body is connected to the gas reservoir via a gas pipe; the controller is configured to control the drive unit, the adjustable gas spring body is disposed in the column, and the drive unit drives the piston rod assembly to carry out a piston motion in the gas reservoir, wherein the column comprise a first column and a second column disposed at two ends of the transverse beam, respectively, the adjustable gas spring body is disposed in the first column, and a synchronous lifting transmission mechanism is provided between the first column and the second column, wherein a self-locking gas spring for driving the second column to lift/lower is provided in the second column, the self-locking gas spring comprises a first self-locking pin and a first cable pulling lever that controls the first self-locking pin, a first cable is provided outside the first cable pulling lever, an end of the first cable is connected to the first cable pulling lever, and the other end of the first cable is connected to a first switch.

2. The pneumatic lifting table frame according to claim 1, wherein the first column comprises a first upper column and a first lower column sleeved on the first upper column; the second column comprises a second upper column and a second lower column; a first fixed post is provided in the first column, and a second fixed post is provided in the second column; a first cable guide wheel is provided at a lower side of an inner wall of the first upper column, and a second cable guide wheel is provided at a lower side of an inner wall of the second upper column; the synchronous lifting transmission mechanism comprises a first transmission belt and a second transmission belt which are spaced apart from each other at an interval, one end of the first transmission belt is fixed to a bottom end of the first lower column, another end of the first transmission belt extends out through a top end of the first column and then into the second column, and is fixed on the second fixed post after passing over the second cable guide wheel; and one end of the second transmission belt is fixed to a bottom end of the second lower column, and another end of the second transmission belt extends out through a top end of the second column and then into the first column, and is fixed on the first fixed post after passing over the first cable guide wheel.

3. The pneumatic lifting table frame according to claim 2, wherein the first fixed post is disposed in the first column, a lengthwise direction of the first fixed post is consistent with a lifting/lowering direction of the first column; the second fixed post is disposed in the second column, and a lengthwise direction of the second fixed post is consistent with a lifting/lowering direction of the second column.

4. The pneumatic lifting table frame according to claim 2, wherein a first mounting box for securing the first column to the transverse beam and a second mounting box for securing the second column to the transverse beam are provided at two ends of the transverse beam, respectively; a first fixed rack is provided in the first mounting box, a first fixed pulley and a second fixed pulley are spaced apart from each other on the first fixed rack in a fore and aft direction; a second fixed rack is provided in the second mounting box, a third fixed pulley and a fourth fixed pulley are spaced apart from each other on the second fixed rack in the fore and aft direction; the first transmission belt, after extending out through the first column, passes over the first fixed pulley and the third fixed pulley and is fixed on the second fixed post; and the second transmission belt, after extending out through the second column, passes over the second fixed pulley and the fourth fixed pulley and is fixed on the first fixed post.

5. The pneumatic lifting table frame according to claim 1, wherein the column is a single column disposed in a middle of the transverse beam, the adjustable gas spring body refers to a self-locking adjustable gas spring, and the self-locking adjustable gas spring includes a second self-locking pin and a second cable pulling lever that controls the second self-locking pin, a second cable is provided outside the second cable pulling lever, an end of the second cable is connected to the second cable pulling lever, and the other end of the second cable is connected to a second switch.

6. The pneumatic lifting table frame according to claim 1, wherein a mounting casing is securely provided on the transverse beam, the controller, the drive unit, the piston rod assembly, and the gas reservoir are disposed in the mounting casing.

7. The pneumatic lifting table frame according to claim 6, wherein the drive unit is a drive motor; the piston rod assembly comprises a screw rod and a piston nut that is sleeved over the screw rod and is movable axially along the screw rod, an output end of the drive motor is connected to the screw rod, the piston nut is disposed in the gas reservoir and is in interference fit with an inner wall of the gas reservoir.

8. A pneumatic lifting table, comprising: a table top, wherein the pneumatic lifting table frame according to claim 1 is disposed beneath the table top.

* * * * *